US005323792A

United States Patent [19]

Caruso

[11] Patent Number: 5,323,792

[45] Date of Patent: Jun. 28, 1994

[54] STEAM HAIR CURLER HAVING AN IMPROVED SHIELD

[76] Inventor: Richard B. Caruso, 619 Croyden Rd., Cheltenham, Pa. 19012

[21] Appl. No.: 125,290

[22] Filed: Sep. 22, 1993

Related U.S. Application Data

[63] Continuation of Ser. No. 770,537, Oct. 3, 1991, abandoned.

[51] Int. Cl.[5] ..... A45D 6/06

[52] U.S. Cl. ..... 132/228; 132/251

[58] Field of Search ..... 132/228, 250, 251, 252

[56] References Cited

U.S. PATENT DOCUMENTS

| | | | |
|---|---|---|---|
| 1,631,989 | 6/1927 | Tabb . | |
| 3,213,860 | 10/1965 | Mizell et al. | 132/228 |
| 3,759,271 | 9/1973 | Caruso | 132/33 |
| 4,453,554 | 6/1984 | Caruso | 132/39 |
| 4,510,953 | 4/1985 | Caruso | 132/40 |
| 4,526,184 | 7/1985 | Caruso | 132/39 |
| 4,603,706 | 8/1986 | Caruso | 132/41 |
| 4,627,452 | 12/1986 | Caruso | 132/33 |
| 4,687,010 | 8/1987 | Caruso | 132/33 |
| 4,955,360 | 9/1990 | Ogawa et al. | 132/228 |

FOREIGN PATENT DOCUMENTS

| | | | |
|---|---|---|---|
| 488823 | 12/1952 | Canada | 132/251 |
| 2030489 | 1/1972 | Fed. Rep. of Germany | 132/251 |
| 7328735 | 7/1975 | France . | |
| 61-148201 | 9/1986 | Japan . | |
| 296190 | 4/1954 | Switzerland | 132/251 |
| 962906 | 10/1959 | United Kingdom . | |

OTHER PUBLICATIONS

Celeste Company, Inc., "Molecular Moisture System," Instruction Booklet, p. 10.

*Primary Examiner*—Gene Mancene
*Assistant Examiner*—Frank A. LaViola
*Attorney, Agent, or Firm*—Woodcock Washburn Kurtz Mackiewicz & Norris

[57] ABSTRACT

A hair curler for use with steam is provided. The hair curler has a central portion having (i) an approximately cylindrical core having a passage for receiving steam, slots for discharging the steam, and first and second ends, (ii) first and second rims formed on the first and second ends, respectively, and (iii) a porous sleeve enclosing a central portion of the core between the core ends and adapted to receive the steam discharging from the core. The curler also has an approximately semi-circular shield adapted to enclose at least a portion of the core, thereby retaining heat emitted by the steam. The shield has first and second ends having first and second end walls, respectively, formed thereon. A slot is formed in each of the end walls. A first portion of each of the slots is adapted to retain the core. A second portion of each of the slots has first and second inward projections defining a throat, the width of each of the throats being less than the outside diameter of the core so as to prevent the core from exiting the first portions of the slots, whereby the shield is secured to the core.

23 Claims, 4 Drawing Sheets

FIG. 8
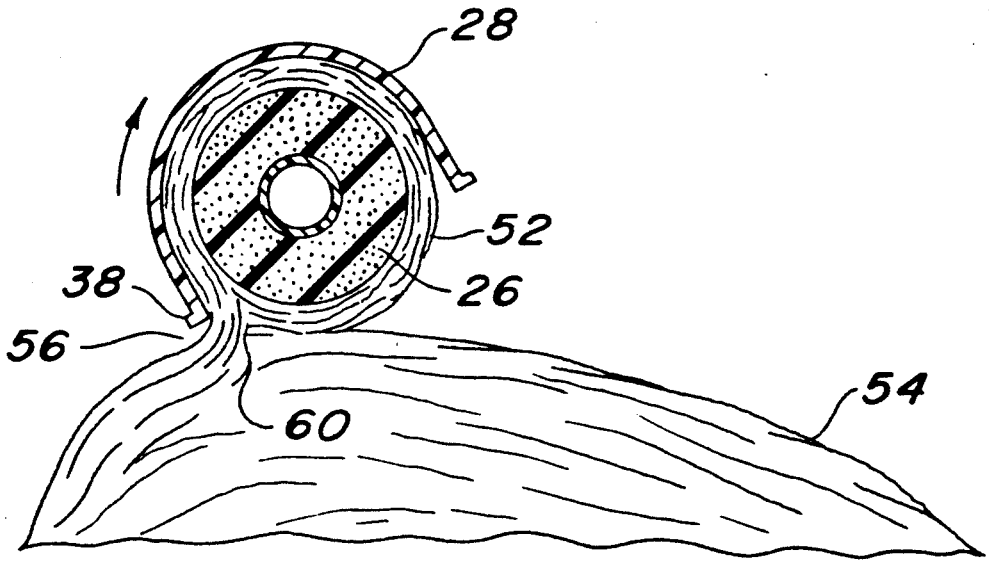
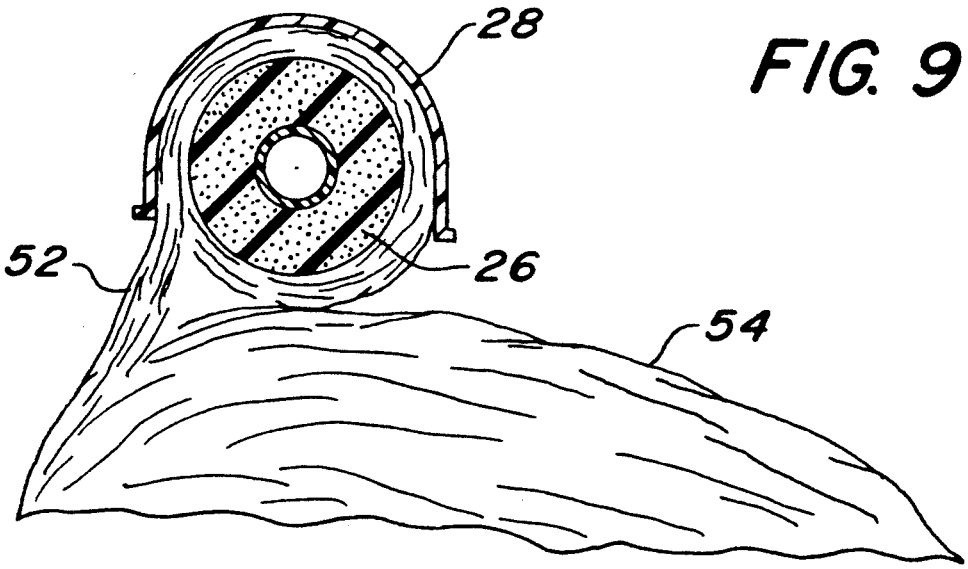
FIG. 9

STEAM HAIR CURLER HAVING AN IMPROVED SHIELD

This is a continuation of application Ser. No. 07/770,537, filed Oct. 3, 1991 abandoned.

FIELD OF THE INVENTION

The current invention is directed to a hair curler. More specifically, the current invention is directed to a hair curler intended for use with steam and having an improved shield for retaining heat while the hair is exposed to the steaming.

BACKGROUND OF THE INVENTION

In the past, porous hair curlers have been developed that use steam to aid in curling—see for example, U.S. Pat. Nos. 3,759,271 (Caruso) and 4,453,554 (Caruso), both of which are hereby incorporated by reference in their entirety. Typically, as shown in FIG. 1, such hair curlers have a central portion 9 that includes a perforated cylindrical central core 12 that forms a passage 62 into which steam is directed from a steam source—for example, a table top steamer. The core 12 has rims 14 and 20 formed on each of its ends and is enclosed by a tubular porous sleeve 26 around which the hair 52 is wound, as shown in FIG. 2. The perforations 22 in the core 12 and the porous nature of the sleeve 26 allow the steam directed into the passage 62 to flow outward so that it is distributed to the hair 52 wound around the sleeve, thereby promoting the desired curling.

Generally, a semi-circular shield (not shown in FIGS. 1 and 2) is employed to at least partially enclose the sleeve 26 after the hair 52 has been wound there-around so that heat emitted by the steam is retained during the curling process. Various methods are known to secure the shield to the central portion 9. One such method, which relies on frictional resistance, is disclosed in the aforementioned U.S. Pat. No. 4,453,554. As disclosed therein, the shield has end walls formed on each of its ends. A slot in each of the end walls allows the end walls to be slipped over the core so that the shield is disposed between the rims and secured thereto by a friction or interference fit. The friction fit is obtained by carefully controlling the size of the components so that the length of the shield is slightly greater than the distance between the inside surfaces of the rims. This causes the end walls of the shield to bear against the inside surfaces of the rims. As a result of the contact between the shield end walls and the rims, motion of the shield relative to the core is restrained by friction, thereby preventing the shield from slipping off of the core. In addition, the width of the slot in the end walls through which the core is disposed corresponds generally to the diameter of the core, thereby providing additional frictional resistance to relative motion of the shield.

Unfortunately, the frictional resistance method of securing the shield to the curler has several serious drawbacks. First, obtaining the appropriate amount of interference between the shield and core is difficult. If the shield is too long relative to the core or the slots in the shield end walls are too narrow relative to the outside diameter of the core, there will be excessive interference, making it difficult to place the shield on the core. Alternatively, if the shield is too short relative to the core or the slots are too wide relative to the outside diameter of the core, there will be insufficient frictional resistance and the shield will not be adequately secured to the core. Consequently, obtaining the appropriate friction fit requires that the tolerance on the dimensions of the shield and core be tightly controlled, thereby increasing manufacturing costs and scrappage.

A second drawback of the frictional resistance method of securing the shield to the core is that it can cause problems in the curling process if the shield is improperly placed on the core. Such improper placement occurs if the shield is placed on the core so that one of its longitudinal edges presses down against the hair, especially in the bang area or when styling a page boy. Although the hair imposes a reacting force on the shield, the frictional resistance prevents the shield from rotating away from the hair so as to alleviate the pressure against the hair. Consequently, there is contact under pressure between the edge of the shield and the hair throughout the curling process. As a result, improper placement of the shield on the curler can cause an undesirable kink to be formed in the hair. Although users may be cautioned against such improper placement of the shield, such instructions are not always followed.

A third drawback of the frictional resistance method of securing the shield to the core is that lubricants used to facilitate the molding of the curler components can reduce the coefficient of friction so that the interference fit alone does not provide sufficient frictional resistance to adequately secure the shield on the core.

Another method for securing the shield to the central portion 9, which does not rely on a friction fit between the shield and the core, is disclosed in the aforementioned U.S. Pat. No. 3,759,271. According to this approach, after the shield is slipped over the core, one leg of a two legged hair clip, such as a bobby pin, is disposed through an arcuate hole in one of the rims so that the clip slips onto the end of the shield with the legs of the clip clamped around the shield, thereby fastening the shield to the rim. Like the friction fit method, this approach does not allow the shield to rotate freely with respect to the core, since the shield and rim are fastened together by the clip. As a result, kinking of the hair can occur if the shield is improperly placed on the core, as previously discussed. In addition, the use of a separate clip complicates the curling process.

Consequently, it would be desirable to provide a hair curler shield that was secured to the curler core so as to be substantially free to rotate without frictional resistance from the curler core or rims and in which the method for securing the shield to the core did not require close control of the dimensions of these components.

It would also be desirable to provide a hair curler shield that incorportated integral means for positively locking the shield onto the curler core.

SUMMARY OF THE INVENTION

It is an object of the current invention to provide a hair curler having a shield which can be coupled to a core without the need to precisely control the dimensions of these components.

It is another object of the invention that the shield be free to rotate around the core without frictional resistance from the core or the rims attached thereto.

It is still another object of the invention to provide a shield having an integral device for positively locking the shield onto the core.

These and other objects are achieved in a hair curler having (i) a longitudinally extending core having first and second ends on which first and second rims, respectively, are formed, and (ii) a longitudinally extending shield adapted to enclose at least a portion of the core. The shield forms (i) a retaining portion adapted to enclose the core and (ii) a throat portion adapted to prevent the core from exiting the retaining portion.

In one embodiment, the shield has first and second ends on which first and second end walls, respectively, are formed. A slot formed in each of the end walls and having opposing inward projecting nubs forms the retaining and throat portions of the shield. The width of the throat portion of the slot is less than the outside diameter of the core. The shield is elastically deformable so that the core can be inserted into the slot by spreading the nubs apart. In one version of this embodiment, the width of the retaining portion of the slot is greater than the outside diameter of the core, whereby the shield is retained on the core while being substantially free to rotate around the core without frictional restraint from the core.

BRIEF DESCRIPTION OF THE DRAWINGS

FIG. 8 is a transverse cross-section of the hair curler shown in FIG. 3 showing the shield as it might initially be applied to the hair.

FIG. 9 is a transverse cross-section of the hair curler shown in FIG. 8 after the shield has rotated into the proper position.

DESCRIPTION OF THE PREFERRED EMBODIMENT

Figure 1:
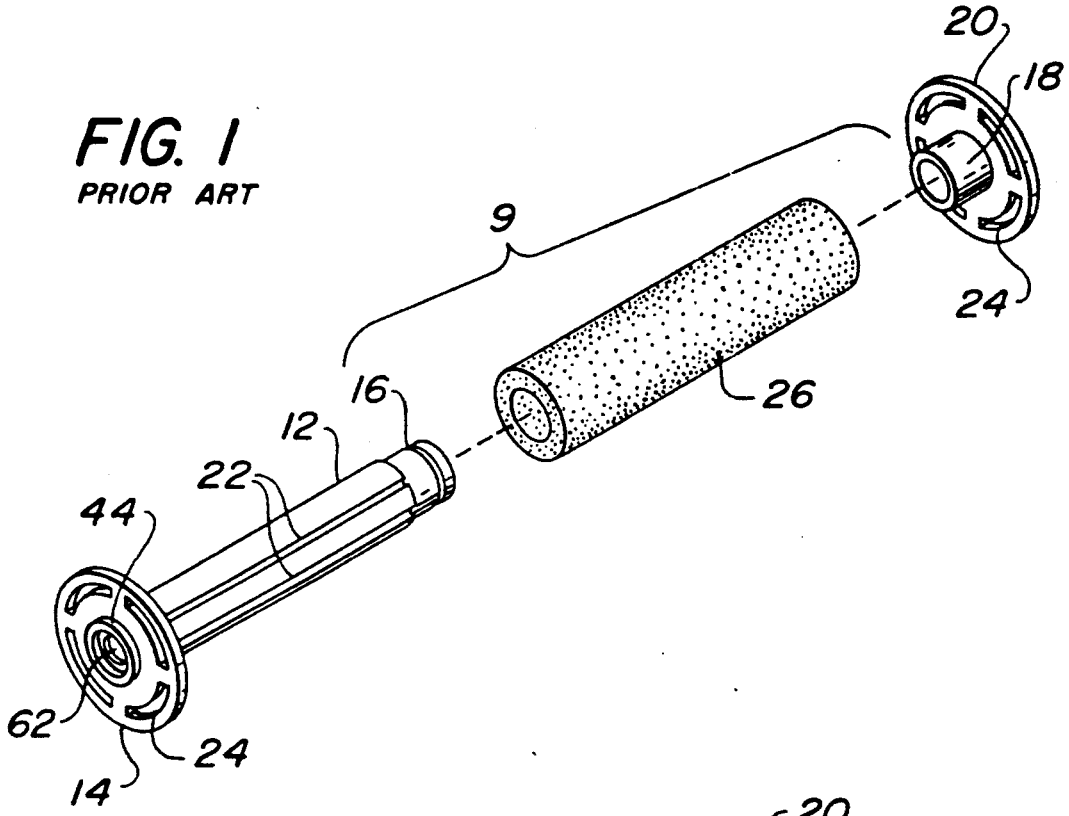
FIG. 1 PRIOR ART
FIG. 1 is an exploded view of the central portion of a hair curler according to the prior art.
Figure 3:
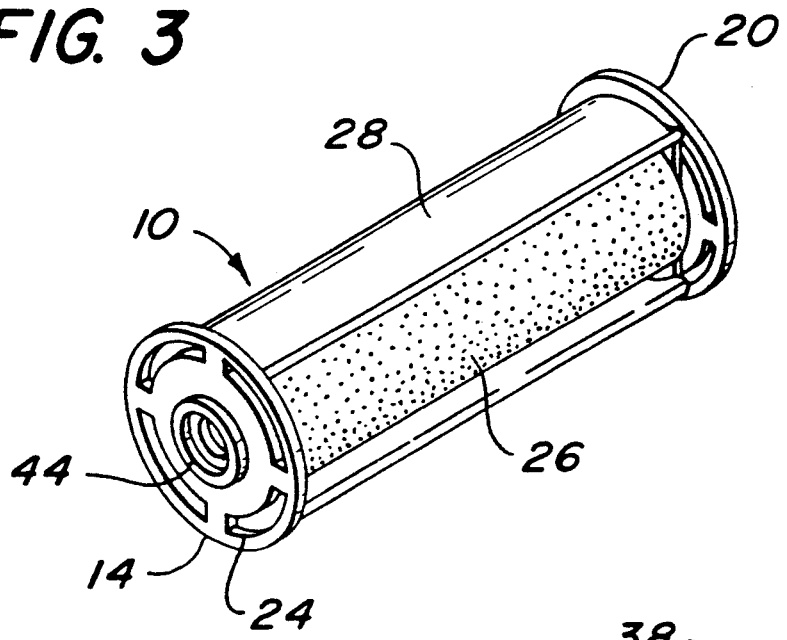
FIG. 3 is a perspective view of a hair curler according to the current invention.

A hair curler 10 according to the current invention is shown in FIG. 3. The hair curler 10 includes a central portion 9, shown in FIG. 1, and a shield 28. The central portion 9 is formed by a core 12, having a hub 18 and rims 14 and 20, and a sleeve 26. The core 12 has two ends, an integral rim 14 being formed on one end and a reduced diameter portion 16 formed on the other end. The reduced diameter portion 16 telescopically receives the hub 18 formed on the second rim 20, the outer diameter of hub 18 being approximately equal to the outer diameter of the cylindrical portion of core 12. The core 12 is hollow and forms a steam passage 62 that extends longitudinally therethrough. An inlet for the steam passage 62 is disposed in the integral rim 14.

The second rim 20 does not have a hole in communication with the steam passage 62, so that the passage is sealed at one end. However, the core 12 has longitudinally extending slots 22 spaced there-around. The slots 22 terminate at the reduced diameter portion 16 and allow steam within the passage 62 to flow radially out of the core 12 and through the tubular porous sleeve 26. A boss 44 is formed in the outward face of the rims 14 and 20. The bosses 44 serve as finger contact portions that facilitate the spinning of the core while grasping the rims.

The sleeve 26 surrounds the core 12 and is preferably formed from a foam polymeric plastic material so as to be highly porous and compressible. The sleeve 26 acts to distribute steam escaping from the slots 22 to the hair wound there-around. The curler 10 is assembled by telescoping the sleeve 26 over the core 12 and then snapping the hub 18 onto the reduced diameter portion 16 with a friction fit.

Figure 4:
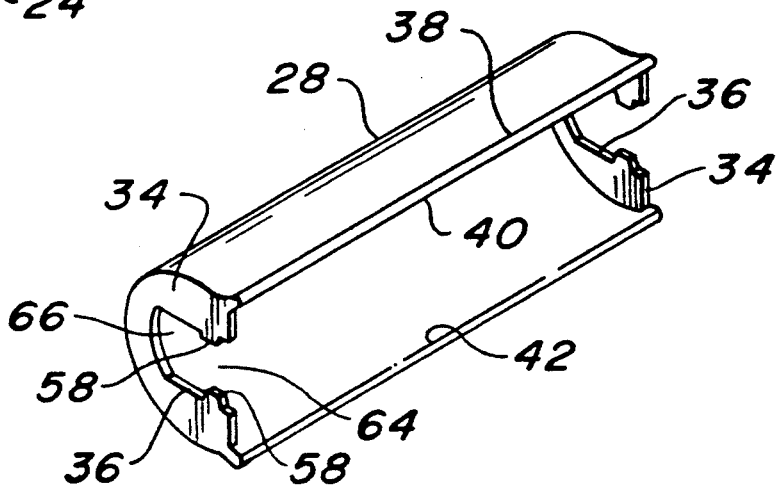
FIG. 4 is a perspective view of one embodiment of the shield of the curler shown in FIG. 3.
Figure 5:
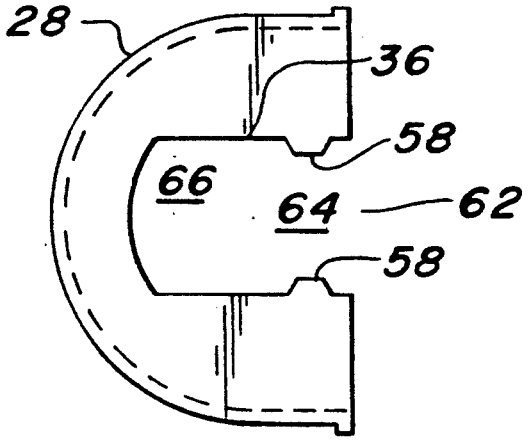
FIG. 5 is an end view of the shield shown in FIG. 4.

The shield 28 serves to retain heat emitted by the steam by partially enclosing the sleeve 26 after the hair has been wound there-around. The shield 28 is generally semicircular and has end walls 34 formed on each of its ends that extend in planes approximately perpendicular to the longitudinal axis of the shield, as shown in FIG. 4. A slot 36 is provided in each end wall 34 and is adapted to receive the core 12. As shown in FIG. 5, two opposing inward extending nubs or projections 58 are formed in the edges of each of the slots 36. The portion of the slot 36 between the nubs 58 defines a throat portion 64 having a width $W_{TH}$. The portion of the slot 36 inboard of the nubs 58—that is, to the left of the nubs 58 as shown in FIG. 5—comprises a retaining portion 66, having a width $W_{RE}$, in which the core 12 is retained, as shown in FIG. 6.

Figure 6:
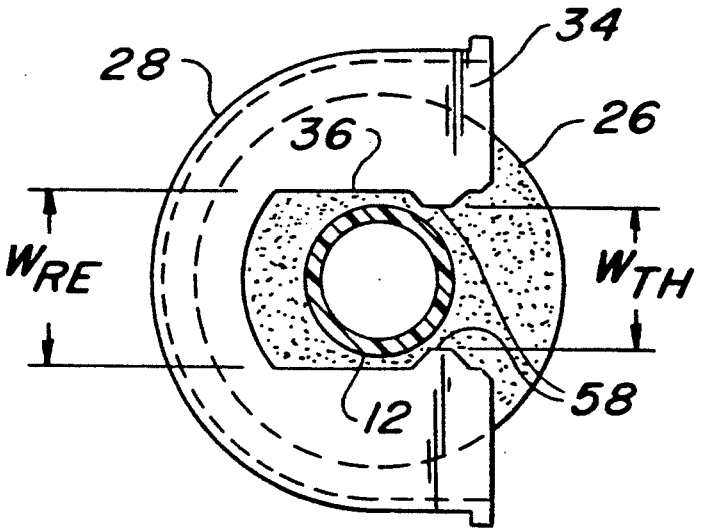
FIG. 6 is a transverse cross-section through the hair curler shown in FIG. 3 incorporating the shield shown in FIG. 4 taken just inboard of the rim 14.

As shown in FIG. 6, according to an important aspect of the current invention, when the shield 28 is in its undeformed state, the width $W_{TH}$ of the slots 36 across the throats 64 is less than the outside diameter of the core 12 and hub 18 In the preferred embodiment, the shield 28 is formed from plastic so that the throat 64 is elastically formed in shield 28. Thus, the core 12 is inserted into the slot 36 by pressing the core against the throat portions 64 of each of the slots, thereby temporarily elastically deforming the shield 28 so that nubs 58 are spread apart. The spreading apart of the nubs 58 as a result of the pressing of the core 12 there-against may be facilitated by sloping the sides of the nubs, as shown in FIG. 5. When the nubs have been spread apart so that the width $W_{TH}$ of the throats 64 is at least as large as the outside diameter of the core 12 and hub 18, the core will pass through the throats into the retaining portions 66 of the slots 36. After passage of the core 12 into the retaining portions 66 of the slots 36, the nubs 58 springs back. This prevents the core 12 from exiting the slots 36, thereby securing the shield 28 to the core.

As the foregoing indicates, frictional resistance is not required to secure the shield 28 to the core 12. As a result, close control of the dimensions of the shield 28 and core 12 is not necessary—the width of the throats 64 must be smaller than the diameter of the core 12 but the magnitude of the difference in these dimensions is not critical since shield is only temporarily elastically deformed to allow entry of the core into the slots, as discussed above. The width of the retaining portions 66 of the slots 36 is also not critical—an interference fit in the retaining portion is not necessary to secure the shield to the core, not will the presence of such an interference fit hinder the nubs 58 in securing of the shield to the core. Nor need the length of the shield be carefully controlled so that it is longer that the distance between the rims 14 and 20 by a precise amount, as was necessary in certain prior art curlers, as previously discussed.

Thus, in one embodiment of the current invention, an interference fit, obtained as previously discussed—that is, by making the length of the shield 28 slightly greater than the distance between the inside surfaces of the rims 14, 20 or making the width of the slots 36 less than the diameter of the core 12—can be incorporated into the hair curler in conjuction with the nubs 58. In this case, the nubs 58 provide a positive method of locking the shield 28 onto the core 12 should the interfernce fit be inadequate to secure the shield, thereby eliminating the need for a seperate clip to ensure that the shield is adequately attached to the core.

According to another embodiment of the current invention, the width $W_{RE}$ of the retaining portions 66 of the slots 36 is greater than the outside diameter of the core 12 and hub 18. In addition, as shown in FIG. 5, the nubs 58 are disposed adjacent the slot opening 62 so that, as shown in FIG. 6, there is sufficient room for the core 12 in the retaining portions 66 to avoid having the nubs press against the core once it passes through the throats 64. Consequently, there is no frictional fit between the slots and the core or hub. Moreover, in this embodiment, the length of the shield 28 is less than the distance between the inside surfaces of the rims 14 and 20 so that there is no frictional fit between the shield end walls 34 and the inside surfaces of the rims.

In this embodiment, as a result of coupling the shield 28 to the core 12 without frictional fits, the shield is substantially free to rotate—that is, capable of rotating in response to a reacting force from the hair when the longitudinal edge of the shield presses into the hair, as discussed further below—around the core without being impeded by frictional resistance from either the core or the rims. This is in contrast to prior art curlers, in which frictional resistance, by both the core against the slot and the rims against the end walls, was used to secure the shield to the central portion and, therefore, impeded free rotation of the shield.

Preferably, in this embodiment, the length and outside diameter of the porous sleeve 26 are less that the distance between the inside surfaces of the shield end walls 34 and the inside diameter of the shield 28, respectively, so that the sleeve 26 does not frictionally restrain the rotation of the shield 28 around the core 12. Alternatively, a frictional fit between the sleeve 26 and the shield 28 could be permitted without precluding the substantially free rotation of the shield if the inside diameter of the sleeve was greater than the outside diameter of the core 12 so that the sleeve was substantially free to rotate around the core, thereby allowing the sleeve and shield to rotate as a unit.

Figure 2:
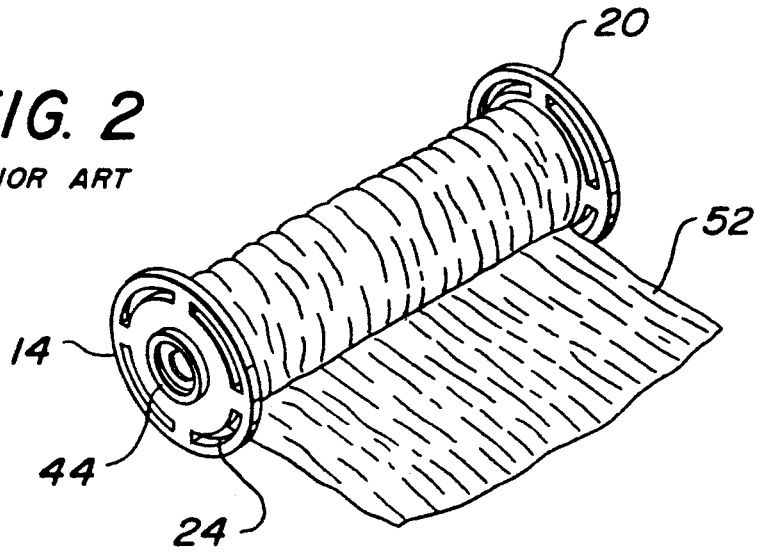
FIG. 2 PRIOR ART
FIG. 2 is a perspective view showing hair being wound around the hair curler central portion shown in FIG. 1.

The hair curler 10 according to this embodiment is used as follows. The central portion of the curler 10 is placed on a table top steamer (not shown) so that steam flows into the passage 62. After a few seconds, the central portion is removed and applied to the hair by wrapping the hair around the sleeve 26, as shown in FIG. 2. Meanwhile, the shield 28 is placed over the steamer so that it remains hot. After hair has been wound around the sleeve 26, a pin or clip may be utilized to anchor the hair to the rims 14 and 20 using the arcuate slots 24 formed therein.

The shield 28 is then placed around the sleeve 26 to retain the heat emitted by the steaming while the curling process occurs. Unlike some prior art curlers, the aforementioned clip, used to anchor the hair to the rims, is not used to secure the shield 28 to the core 12. Instead, the shield 28 is secured to the central portion by pressing the core 12 into the slots 36 so as to spread the nubs 58 until the core enters the retaining portions 66 of the slots, as previously discussed.

After exposing the hair to the steam escaping radially outwardly through slots 22 and sleeve 26 for a few minutes, the shield 28 is removed by pulling on the shield so that the core 12 presses against the throat 64, thereby again elastically deforming the shield so as to spread the nubs 58 apart. Thereafter, the central portion of the curler is separated from the hair by placing the finger tips in the bosses 44 formed in the outside surfaces of the rims 14 and 20 and pulling it away from the head so that, as the core spins, it unwinds itself from the hair.

After the hair has been wrapped around the sleeve 26, it has been found that the user sometimes improperly places the shield 28 on the central portion of the curler 10 so that the longitudinal edge 38 of the shield presses into the hair 52, thereby forming a kink 56, as shown in FIG. 8. If the shield is left in this position during the curling process, the undesirable kink 56 will remain in the hair after the curler is removed. Such a situation was possible on prior art curlers because the means for securing the shield to the central portion, whether a frictional resistance fit or a clip, prevented the shield from rotating so as to relieve the pressure on the hair.

However, according to the aforementioned embodiment of the current invention, the shield 28 is rotatably coupled to the central portion via the nubbed slots 36 and does not rely on frictional resistance between the core 12 and the slot 36 or between the shield end walls 34 and the rims 14 and 20 to secure the shield to the central portion. As a result, there is substantially no frictional resistance between the shield 28 and the core 12 or the rims 14 and 20. Thus, the reacting force 60 from the compressed hair 52, which is applied approximately tangentially to the longitudinal edge 38 of the shield 28, causes the shield to automatically rotate away from the kink 56, as shown in FIG. 9, thereby relieving the pressure on the hair and preventing the formation of the kink 56.

Figure 7:
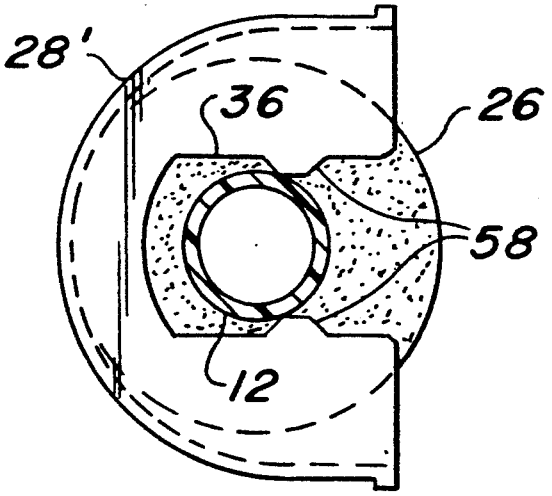
FIG. 7 is a transverse cross-section through the hair curler shown in FIG. 3 showing an alternate embodiment of the shield shown in FIG. 6.

Although the nubs 58 are shown in FIG. 5 as being adjacent the slot opening 62, the nubs can be placed anywhere along the slot 36 provided they are still capable of retaining the core 12. Indeed, according to another embodiment of the current invention, the nubs 58 are disposed sufficiently far into slots 36 so that they bear against the core 12, as shown in FIG. 7. In this arrangement, the nubs 58 will positively lock the shield 28' onto the core 12 while imposing a frictional resistance restraining the shield from rotating freely around the core.

The present invention may be embodied in other specific forms without departing from the spirit or essential attributes thereof and, accordingly, reference should be made to the appended claims, rather than to the foregoing specification, as indicating the scope of the invention.

What is claimed is:

1. A hair curler for use with steam comprising:

a) a central portion having (i) an approximately cylindrical core having means for receiving steam and means for discharging said steam, and (ii) a porous sleeve enclosing at least a portion of said core and having means for receiving said steam discharging therefrom; and b) an approximately cylindrical shield having means for at least partially enclosing said central portion, thereby retaining heat emitted by said steam, said shield having first and second walls oriented approximately perpendicularly to the longitudinal axis of said shield, each of said walls having means for rotatably coupling said shield to said core without frictional resistance therefrom, said shield being substantially free to rotate about said core central portion.

2. The hair curler according to claim 1, wherein said core has first and second ends, and wherein said central portion further comprises first and second approximately circular rims attached to said first and second cord ends, respectively.

3. The hair curler according to claim 2, wherein said shield is disposed between said first and second rims, and wherein the length of said shield is less than the distance between said first and second rims.

4. The hair curler according to claim 1, wherein said shield further comprises first and second ends on which said first and second walls, respectively, are formed.

5. The hair curler according to claim 4, wherein said rotatable coupling means comprises a slot formed in each of said walls having means for slipping over said core, each of said slots having maximum and minimum widths, said maximum width of each of said slots being greater than the outside diameter of said core.

6. The hair curler according to claim 5, wherein said minimum width of each of said slots is less than the outside diameter of said core.

7. The hair curler according to claim 5, wherein each of said slots has first and second edges forming the sides of said slot, and wherein said rotatable coupling means further comprises an inwardly projecting nub formed on each of said first edges, the distance from said nub to said second edge in each of said slots being less than the outside diameter of said core.

8. The hair curler according to claim 5, wherein each of said slots has first and second edges forming the sides of said slot, and wherein said rotatable coupling means further comprises first and second inwardly projecting nubs formed on said first and second edges, respectively, of each of said slots, the distance between said first and second nubs in each of said slots being less than the outside diameter of said core.

9. A hair curler, comprising:

a) a longitudinally extending core; and b) a longitudinally extending shield having means for enclosing at least a portion of said core, said shield having a first wall extending in a plane approximately perpendicular to the longitudinal axis of said shield, said wall forming (i) a retaining portion having means for containing said core without imposing frictional resistance thereon and (ii) a throat portion having means for preventing said core from exiting said retaining portion without imposing frictional resistance thereon, whereby said shield is retained on said core while being substantially free to rotate around said core without frictional restraint from said core.

10. The hair curler according to claim 9, wherein said core has an outside dimension in a plane transverse to the longitudinal direction in which said core extends, and wherein the width of said throat portion is less than said outside transverse dimension of said core when said shield is in an undeformed state.

11. The hair curler according to claim 10, wherein the width of said retaining portion is greater than the outside transverse dimension of said core.

12. The hair curler according to claim 10, wherein said throat portion has means for receiving said core by temporarily elastically deforming said shield so that the width of said throat portion is at least equal to the outside transverse dimension of said core during said insertion.

13. The hair curler according to claim 10, wherein a first slot is disposed in said first wall, said first slot forming both said retaining portion and said throat portion.

14. The hair curler according to claim 13, wherein said throat portion is formed in part by a first projection extending inwardly from said first wall into said first slot.

15. The hair curler according to claim 14, wherein said throat portion is further formed by a second projection extending inwardly from said first wall into said first slot and opposing said first projection.

16. The hair curler according to claim 14, wherein said shield further comprises a second wall extending in a plane approximately perpendicular to the longitudinal axis of said shield, a second slot disposed in said second wall forming both a second retaining portion and a second throat portion, said second throat portion formed in part by a second projection extending inwardly from said second wall into said second slot.

17. The hair curler according to claim 16, wherein said first and second walls form end walls of said shield.

18. A hair curler comprising:

a) an approximately cylindrical core; and b) an approximately semi-circular shield having means for enclosing at least a portion of said core, said shield having first and second ends having first and second end walls, respectively, formed thereon, a slot formed in each of said end walls defining a retaining portion having means for retaining said core, each of said slots having integral means for positively locking said core within said retaining portion whether or not frictional resistance is present between said core and said retaining portion, each of said integral positive locking means having a first inward projection formed in said slot and defining a throat portion, the width of each of said throat portions of said slots being less than the outside diameter of said core, whereby said throat portions prevent said core from exiting said retaining portions of said slots.

19. The curler according to claim 18, further comprising frictional means for securing said shield to said core.

20. The curler according to claim 19, wherein said frictional securing means comprises said retaining portions having a width less than the outside diameter of said core, whereby said shield is secured to said core by frictional resistance between said core and said retaining portions of said slots.

21. The curler according to claim 19, wherein said core comprises first and second ends having first and second rims, respectively, formed thereon, said shield being disposed between said rims, and wherein said frictional securing means comprises said the length of said shield being greater than the distance between said rims, whereby said shield is secured to said core by frictional resistance between said shield and said rims.

22. The curler according to claim 18, wherein said core comprises first and second ends having first and second rims, respectively, formed thereon, said shield being disposed between said rims, the length of said shield being less than the distance between said rims, and wherein said retaining portions have a width greater than the outside diameter of said core, whereby said shield is rotatably coupled to said core so as to be free to rotate about said core without frictional resistance from said core and said rims.

23. The curler according to claim 18, wherein said core comprises first and second ends having first and second rims, respectively, formed thereon, a finger contact portion being formed in each of said rims, thereby facilitating rotation of said core while gripping said rims.

* * * * *

UNITED STATES PATENT AND TRADEMARK OFFICE

CERTIFICATE OF CORRECTION

PATENT NO. : 5,323,792

DATED : June 28, 1994

INVENTOR(S) : Caruso

It is certified that error appears in the above-identified patent and that said Letters Patent is hereby corrected as shown below:

Column 4, line 36, after 18, please insert a period --.--;
Column 5, line 11, please delete the word "interfernce" and insert therefor --interference--;
Column 5, line 13, please delete the word "seperate" and insert therefor --separate--;
Column 5, line 42, please delete the word "that" and insert therefor --than--.

Signed and Sealed this

Fourteenth Day of March, 1995

*Attest:*

*Attesting Officer*

BRUCE LEHMAN

*Commissioner of Patents and Trademarks*